US011474546B2

(12) United States Patent
Tyagi et al.

(10) Patent No.: US 11,474,546 B2
(45) Date of Patent: *Oct. 18, 2022

(54) METHOD OF OPERATING A LOW DROPOUT REGULATOR BY SELECTIVELY REMOVING AND REPLACING A DC BIAS FROM A POWER TRANSISTOR WITHIN THE LOW DROPOUT REGULATOR

(71) Applicant: STMicroelectronics International N.V., Schiphol (NL)

(72) Inventors: Kapil Kumar Tyagi, Greater Noida (IN); Nitin Gupta, Kurukshetra (IN)

(73) Assignee: STMicroelectronics International N.V., Schiphol (NL)

( * ) Notice: Subject to any disclaimer, the term of this patent is extended or adjusted under 35 U.S.C. 154(b) by 0 days.

This patent is subject to a terminal disclaimer.

(21) Appl. No.: 17/012,478

(22) Filed: Sep. 4, 2020

(65) Prior Publication Data

US 2020/0401169 A1 Dec. 24, 2020

Related U.S. Application Data

(60) Continuation of application No. 16/217,872, filed on Dec. 12, 2018, now Pat. No. 10,795,389, which is a (Continued)

(51) Int. Cl.
*G05F 1/575* (2006.01)
*G05F 1/46* (2006.01)
(Continued)

(52) U.S. Cl.
CPC ..... *G05F 1/468* (2013.01); *G05F 1/575* (2013.01); *G05F 1/613* (2013.01); *G05F 1/561* (2013.01)

(58) Field of Classification Search
CPC ..... G05F 1/468–613
See application file for complete search history.

(56) References Cited

U.S. PATENT DOCUMENTS 6,087,893 A 7/2000 Dowaki et al.
9,285,821 B2 3/2016 Maeda et al.
(Continued)

FOREIGN PATENT DOCUMENTS

CN 103186157 A 7/2013
CN 103901934 A 7/2014
CN 206877187 U 1/2018

OTHER PUBLICATIONS

First Office Action and Search Report for CN Appl. No. 201710258753.6 dated Sep. 29, 2019 (11 pages), which CN Appl. is family-related to the instant US application, with translation.
(Continued)

*Primary Examiner* — Peter M Novak
(74) *Attorney, Agent, or Firm* — Crowe & Dunlevy

(57) ABSTRACT

A method is for operating an electronic device formed by a low dropout regulator (LDO) having an output coupled to a first conduction terminal of a transistor, with a second conduction terminal of the transistor being coupled to an output node. The electronic device is turned on by turning on the LDO, removing a DC bias from the second conduction terminal of the transistor by opening a first switch that selectively couples the second conduction terminal of the transistor to a supply node through a first diode coupled transistor and by opening a second switch that selectively couples the second conduction terminal of the transistor to a ground node through a second diode coupled transistor, and turning on the transistor. The electronic device is turned off by turning off the transistor, forming the DC bias at the second conduction terminal of the transistor, and turning off the LDO.

20 Claims, 3 Drawing Sheets

Related U.S. Application Data division of application No. 15/475,266, filed on Mar. 31, 2017, now Pat. No. 10,198,014.

(51) Int. Cl.
*G05F 1/613* (2006.01)
*G05F 1/56* (2006.01)

(56) References Cited

U.S. PATENT DOCUMENTS

| | | | |
|---|---|---|---|
| 2003/0218476 | A1 | 11/2003 | Lindsay et al. |
| 2006/0267673 | A1 | 11/2006 | Gan et al. |
| 2006/0284658 | A1 | 12/2006 | Wright |
| 2011/0248865 | A1 | 10/2011 | Hong et al. |
| 2012/0256608 | A1 | 10/2012 | Huang |
| 2013/0169246 | A1 | 7/2013 | Shao |
| 2015/0241889 | A1 | 8/2015 | Chen et al. |

OTHER PUBLICATIONS

Second Office Action and Search Report for CN Appl. No. 201710258753.6 dated May 19, 2020 (8 pages), which CN Appl. is family-related to the instant US application, with translation.
Third Office Action and Search Report for CN Appl. No. 201710258753.6 dated Nov. 20, 2020 (7 pages), which CN Appl. is family-related to the instant US application, with translation.

METHOD OF OPERATING A LOW DROPOUT REGULATOR BY SELECTIVELY REMOVING AND REPLACING A DC BIAS FROM A POWER TRANSISTOR WITHIN THE LOW DROPOUT REGULATOR

RELATED APPLICATION

This application is a continuation of U.S. patent application Ser. No. 16/217,872, filed Dec. 12, 2018, which is a divisional of U.S. patent application Ser. No. 15/475,266, filed Mar. 31, 2017, now U.S. Pat. No. 10,198,014, the contents of both of which are incorporated by reference in their entireties.

TECHNICAL FIELD

This disclosure is related to the field of low dropout regulators, and more particularly, to a low dropout regulator that utilizes a low voltage ballast transistor for high bandwidth and power supply rejection, and that protects the low voltage ballast transistor from electrical overstresses.

BACKGROUND

Handheld battery powered electronic devices such as tablets and smartphones have been in wide use in recent years, with usage rates that are ever increasing, and with additional functionality being added on a regular basis.

A common type of voltage regulator used in such electronic devices is known as a low dropout (LDO) regulator, which can operate with a small input to output voltage difference, and which provides a high degree of efficiency and heat dissipation. A typical LDO regulator includes an error amplifier that controls a field effect transistor (FET) or bipolar junction transistor (BJT) to cause that transistor to sink or source current from or to an output node. One input of the error amplifier receives a feedback signal, while the other receives a reference voltage. The error amplifier controls the power FET or BJT so as to maintain a constant output voltage.

The power FET or BJT is typically tolerant of 5V, meaning that the FET or BJT therefore has a large area and a low transconductance, however to source or sink a high current, a large transconductance would instead be required, leading to a very large sized transistor. This in turn would lead to high leakage current when the LDO is powered down. In addition, the bandwidth of the LDO is limited by a high input gate to base capacitance to the power FET or BJT. Another drawback of this design is that the power FET or BJT has a large gate to drain or base to emitter capacitance and total gate or drain capacitance due to its size, which results in degradation in high frequency power source noise rejection.

In an attempt to address these drawbacks, additional designs have been devised. For example, a LDO 100 is shown in FIG. 1. In this LDO, amplifier 102 has its inverting input terminal coupled to a reference voltage Vref, its non-inverting input terminal coupled to receive a feedback voltage Vfb, and its output coupled to the gate of p-channel transistor T1. P-channel transistor T1 has its source coupled to a supply voltage Vdd and its drain coupled to node N1. P-channel transistor T2 has its source coupled to node N1, its drain coupled to provide the output of the LDO Vout at node N3, and its gate coupled to the output of amplifier 104. Amplifier 104 has its inverting terminal coupled to node N1 and its non-inverting terminal coupled to receive comparison voltage Vc. A resistive divider formed from series coupled resistances R1 and R2 is coupled between node N3 and ground. A center tap N2 of the resistive divider formed by R1 and R2 is coupled to the non-inverting terminal of amplifier 102 to provide the feedback voltage Vfb thereto.

The transistors T1 and T2 are low voltage devices, and are to be protected from electrical overstresses. When the LDO 100 is operating in a normal power on mode, T2 is biased by amplifier 104 such that it acts as a switch. When the LDO 100 is powered down, node N1 is biased such that neither T1 nor T2 experiences overstresses. However, during the transition between the powered on mode and the powered down mode, or between the powered down mode and the powered on mode, node N1 can intermittently go to supply or ground at a different time constant than node N3, which can also go to ground. Transistor T1 can be stressed because it has no protections against such overstresses, and transistor T2 can be stressed because it is within the feedback loop.

Further development of LDO regulators is necessary to address the aforementioned drawbacks.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Disclosed herein is a method of operating an electronic device including a low dropout regulator having an output coupled to a first conduction terminal of a transistor, with a second conduction terminal of the transistor being coupled to an output node of the electronic device. The method includes placing the electronic device into a power on mode by: turning on the low dropout regulator, removing a DC bias from the second conduction terminal of the transistor, and turning on the transistor. The method also includes placing the electronic device into a power down mode by: turning off the transistor, forming the DC bias at the second conduction terminal of the transistor, and turning off the low dropout regulator.

When placing the electronic device into the power on mode, the transistor may be turned on before the DC bias is removed from the second conduction terminal of the transistor.

When placing the electronic device into the power on mode, the transistor may be turned on after the DC bias is removed from the second conduction terminal of the transistor.

When placing the electronic device into the power on mode, the transistor may be turned on substantially simultaneously with removal of the DC bias from the second conduction terminal of the transistor.

When placing the electronic device into the power down mode, the transistor may be turned off before the DC bias is formed at the second conduction terminal of the transistor.

When placing the electronic device into the power down mode, the transistor may be turned off after the DC bias is formed at the second conduction terminal of the transistor.

When placing the electronic device into the power down mode, the transistor may be turned off substantially simultaneously with forming of the DC bias at the second conduction terminal of the transistor.

Turning on the low dropout regulator may include opening a fourth switch that selectively couples an output of an amplifier of the low dropout regulator to the supply node, opening a third switch that selectively couples the output of the low dropout regulator to the supply node, and opening a sixth switch that selectively couples a resistive divider to the ground node.

Turning on the low dropout regulator may be performed prior to removing the DC bias from the second conduction terminal of the transistor.

Turning on the transistor may be performed by coupling a control terminal of the transistor to the ground node.

Turning off the transistor may be performed by coupling a control terminal of the transistor to the supply node.

Forming the DC bias at the second conduction terminal of the transistor may be performed by closing the first switch and closing the second switch.

Also disclosed herein is an electronic device including an intermediate node, a resistive divider directly electrically connected between the intermediate node and a divider control node, and a low dropout regulator. The low dropout regulator includes an amplifier having an inverting terminal receiving a reference voltage, a non-inverting terminal directly electrically connected to a tap node of the resistive divider, and an output, and a ballast transistor having a first conduction terminal coupled to a supply node, a second conduction terminal coupled to the intermediate node, and a control terminal coupled to the output of the amplifier. A transistor has a first conduction terminal coupled to the intermediate node, a second conduction terminal coupled to an output node, and a control terminal. A first impedance is coupled to the output node. A second impedance is coupled to the output node. A first switch is configured to selectively couple the first impedance to the supply node. A second switch is configured to selectively couple the second impedance to the ground node. A third switch is coupled between the intermediate node and the supply node. A fourth switch is coupled between the output of the amplifier and the supply node. A fifth switch that is a three position switch is for selectively coupling the control terminal of the transistor to the supply node or to ground. A sixth switch is coupled between the divider control node and ground.

The first switch may be a PMOS transistor having a source coupled to the supply node, a drain coupled to the first impedance, and a gate biased by the control circuitry.

The second switch may be an NMOS transistor having a drain coupled to the output node, a source coupled to ground, and a gate biased by the control circuitry.

The third switch may be a PMOS transistor having a source coupled to the supply node, a drain coupled to the intermediate node, and a gate biased by the control circuitry.

The fourth switch may be a PMOS transistor having a source coupled to the supply node, a drain coupled to the output of the amplitude, and a gate biased by the control circuitry.

The sixth switch may be an NMOS transistor having a drain coupled to the divider control node, a source coupled to ground, and a gate coupled to an output of an inverter, the inverter having its input coupled to the control circuitry.

The supply node may be at a voltage in a range of 1 to 5 volts.

The supply node may be at a voltage of 1.8V, 2.5V, or 5V.

The ballast transistor may be a low voltage p-channel transistor.

The transistor may be a PMOS transistor.

DETAILED DESCRIPTION

One or more embodiments of the present disclosure will be described below. These described embodiments are only examples of the presently disclosed techniques. Additionally, in an effort to provide a concise description, some features of an actual implementation may not be described in the specification. When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements.

Figure 1:
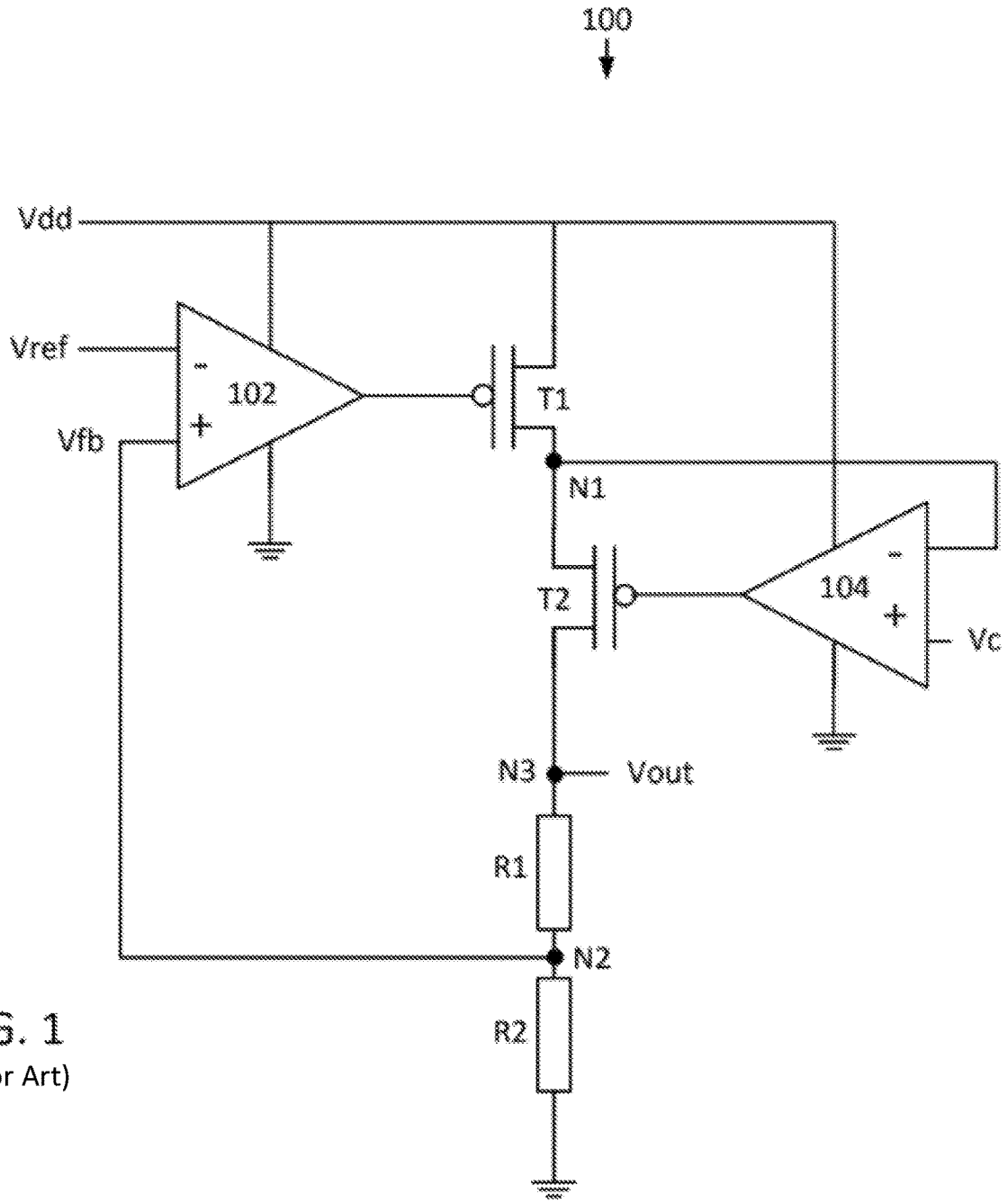
FIG. 1 (Prior Art)
FIG. 1 is a schematic block diagram of a prior art low dropout regulator.
Figure 2:
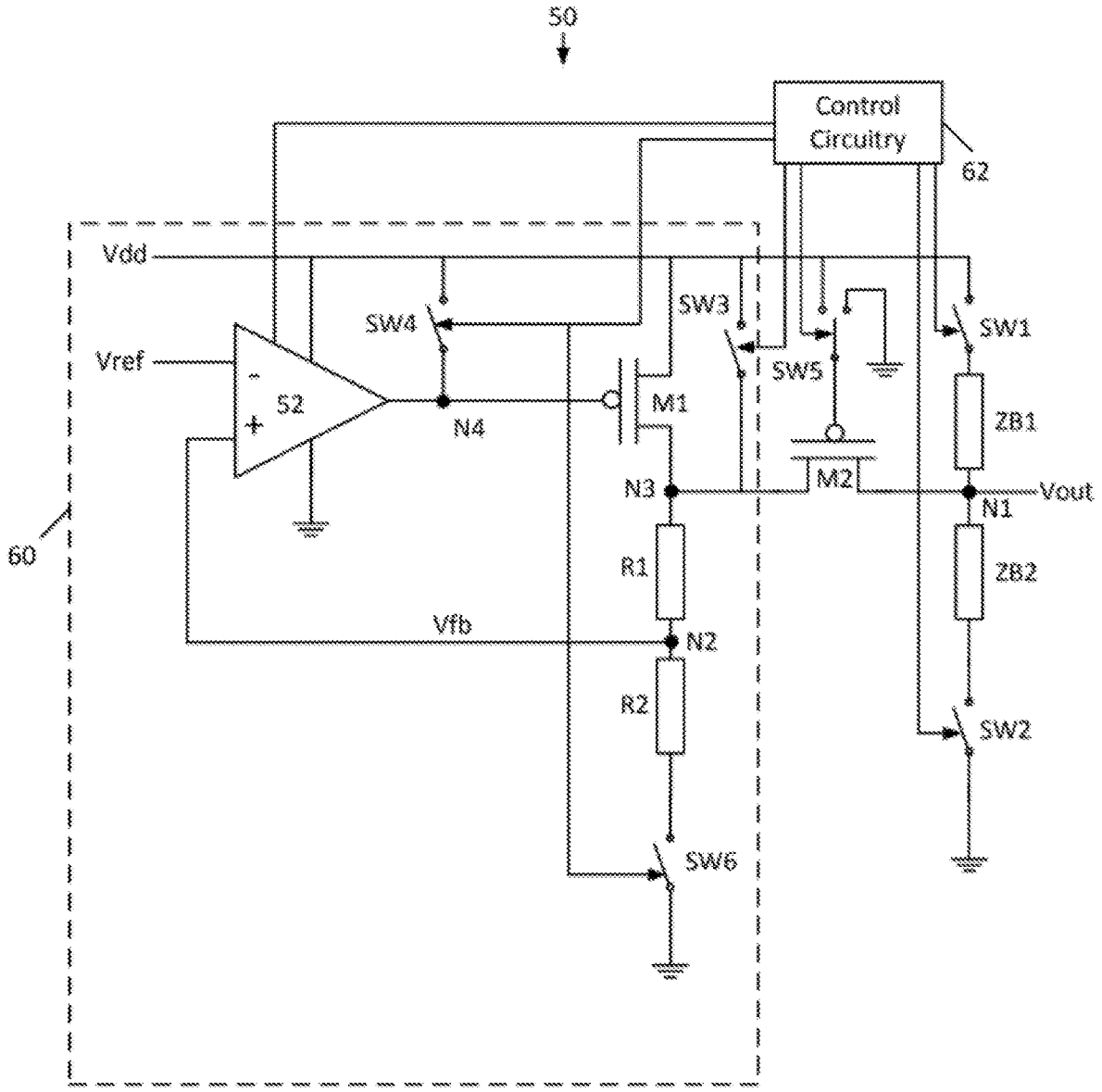
FIG. 2 is a schematic block diagram of an electronic device in accordance with this disclosure.

With reference to FIG. 2, a circuit 50 including a low dropout regulator and its control and bias circuitry is now described. The circuit 50 includes a low dropout regulator 60 receiving a reference signal Vref as input, and providing output to an intermediate node N3.

The low dropout regulator 60 itself is comprised of an error amplifier 52 receiving the reference signal at a first input (non-inverting input terminal), and a feedback signal Vfb at a second input (inverting input terminal), and providing an output to node N4. The error amplifier 52 is powered between a supply voltage Vdd and ground. The supply voltage Vdd may be 5 V, 2.5 V, 1.8 V, 1V a voltage between 1 V and 5 V, or another suitable voltage.

The low dropout regulator 60 includes a low voltage p-channel transistor M1, which may be a PMOS transistor in some cases, and in some cases, may be a low voltage thin gate oxide transistor. The low-voltage p-channel transistor M1 serves as the ballast for the low dropout regulator 60. The p-channel transistor M1 has its source coupled to the supply voltage Vdd, its drain coupled to intermediate node N3, and its gate coupled to node N4 at the output of the error amplifier 52. A switch SW4 selectively couples node N4 (and thus the gate of the p-channel transistor M1) to the supply voltage Vdd. A switch SW3 selectively couples intermediate node N3 (and thus the drain of the p-channel transistor M1) to the supply voltage Vdd.

A first resistance R1 is coupled between the intermediate node N3 and node N2, while a second resistance R2 is coupled between the node N2 and switch SW6. Switch SW6 is coupled between resistance R2 and ground. The first resistance R1 and second resistance R2 may have the same resistance values or may have different resistance values, and in some cases one or both of these resistances R1, R2 may be programmable. R1 and R2 form a resistive voltage divider receiving the voltage at node N3 and outputting a feedback voltage Vfb.

Another low-voltage p-channel transistor M2 has its source coupled to the intermediate node N3, its drain coupled to the output node N1, and its gate selectively coupled to either the supply voltage Vdd or ground by the switch SW5. This p-channel transistor M2 may also be a PMOS transistor in some cases.

A first impedance ZB1 is coupled to the output node N1, and is selectively coupled to the supply voltage Vdd by switch SW1. A second impedance ZB2 is also coupled to the output node N1, and is selectively coupled to ground by switch SW2. The first impedance ZB1 and second impedance ZB2 may have a same impedance value, or may have different impedance values.

The switches SW1, SW2, SW3, SW4, SW5, and SW6 are coupled to control circuitry 62, which serves to control actuation and deactuation of those switches via the generation of appropriate control signals.

The circuit 50 may operate in a powered down mode or a powered on mode. To switch into the powered on mode from a power off condition, the control circuitry 62 first turns on the error amplifier 52, and then opens switches SW6, SW4, and SW3. This serves to activate the low dropout regulator 60.

Then, the control circuitry 62 opens switches SW2 and SW1, removing any DC bias present at the drain of the p-channel transistor M2 at node N1. Thereafter, the control circuitry 62 sets the switch SW5 to couple the gate of transistor M2 to ground, turning the transistor M2 on.

In some cases when switching into the powered on mode, the control circuitry 62 may open switches SW2 and SW1, as well as set the switch SW5 to couple the gate of transistor M2 to ground, substantially simultaneously. In others, the control circuitry 62 may set the switch SW5 to couple the gate of transistor M2 to ground before opening the switches SW2 and SW1.

To switch into the powered down mode, the control circuitry 62 first sets the switch SW5 to couple the gate of the p-channel transistor M2 to the supply voltage Vdd to thereby turn off the p-channel transistor M2. Then, the control circuitry 62 closes the switches SW2 and SW1, forming a DC bias at the drain of the p-channel transistor M2. Thereafter, the control circuitry 62 closes switches SW6, SW4, and SW3, coupling the drain and gate of the p-channel transistor M1 to the supply voltage Vdd, thereby turning the p-channel transistor M1 off. Lastly, the error amplifier 52 is turned off.

In powered down mode, the closing of switches SW6, SW4, and SW3 protects the p-channel transistor M1, as its source, drain, and gate are all coupled to the same supply voltage Vdd. Similarly, the DC bias formed at the drain of the p-channel transistor M2 by the impedances ZB1 and ZB2 helps serve to protect the p-channel transistor M2.

In some cases when switching into the powered down mode, the control circuitry 62 may close switches SW2 and SW1, as well as set the switch SW5 to couple the gate of transistor M2 to the power supply node Vdd, substantially simultaneously. In others, the control circuitry 62 may set the switch SW5 to couple the gate of transistor M2 to the power supply node Vdd before closing the switches SW2 and SW1.

The voltage drop across p-channel transistor M2 is minimal, and neither of the p-channel transistors M1 or M2 are overstressed. However, the p-channel transistor M1 has a higher transconductance than the ballast transistor in prior art designs, and the size of the p-channel transistor M1 can be smaller than in prior art designs. Due to the smaller size of the p-channel transistor M1, the gate to drain capacitance is less than in prior designs. As a result, the p-channel transistor M1 can be fabricated such that the bandwidth of the circuit 50 can be high, and the power supply rejection can be high. Alternatively, the p-channel transistor M1 can be fabricated such that the quiescent current therethrough is substantially lowered, but with the bandwidth and power supply rejection of the circuit 50 remaining the same as prior art devices.

Figure 3:
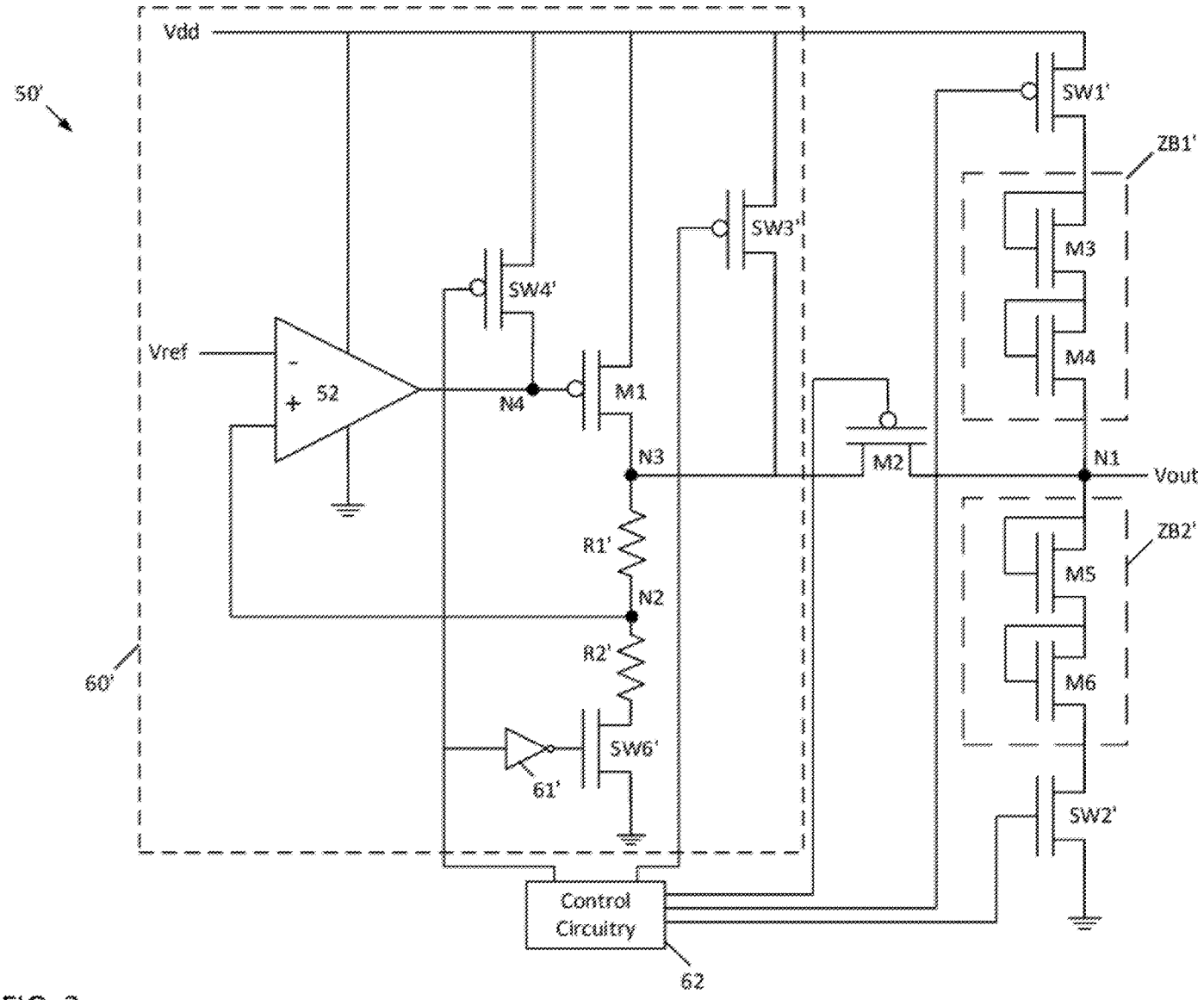
FIG. 3 is a more detailed schematic block diagram of the electronic device of FIG. 2.

With additional reference to FIG. 3, additional details of an additional embodiment are now given. The circuit 50' shown in FIG. 3 operates the same as the circuit 50 shown in FIG. 2, therefore operation details need not be given. Here, the resistances R1' and R2' are resistors, and the impedances ZB1' and ZB2' are each pairs of diode coupled n-channel transistors (such as a NMOS transistors), M3 and M4, and M5 and M6. Switch SW1' is a p-channel transistor (such as a PMOS transistor) having a source coupled to the supply voltage Vdd, a drain coupled to the impedance ZB1', and a gate coupled to the control circuitry 62. Switch SW2' is an n-channel transistor (such as a NMOS transistor) having a drain coupled to the impedance ZB2', a source coupled to ground, and a gate coupled to the control circuitry 62. Switch SW3' is a p-channel transistor (such as a PMOS transistor) having a source coupled to the supply voltage Vdd, a drain coupled to the intermediate node N3, and a gate coupled to the control circuitry 62. Switch SW4' is a p-channel transistor (such as a PMOS transistor) having a source coupled to the supply voltage Vdd, a drain coupled to the gate of p-channel transistor M1, and a gate coupled to the control circuitry 62. Switch SW6' is an n-channel transistor (such as an NMOS transistor) having a drain coupled to resistance R2', a source coupled to ground, and a gate coupled to the control circuitry 62 through an inverter 61.

While the disclosure has been described with respect to a limited number of embodiments, those skilled in the art, having benefit of this disclosure, will appreciate that other embodiments can be envisioned that do not depart from the scope of the disclosure as disclosed herein. Accordingly, the scope of the disclosure shall be limited only by the attached claims.

The invention claimed is:

1. A method of operating an electronic device comprised of a low dropout regulator having an output coupled to a first conduction terminal of a transistor, with a second conduction terminal of the transistor being coupled to an output node of the electronic device, wherein the method comprises:

placing the electronic device into a power on mode by:

turning on the low dropout regulator, removing a DC bias from the second conduction terminal of the transistor by opening a first switch that is for selectively coupling the second conduction terminal of the transistor to a supply node through a first impedance and by opening a second switch that is for selectively coupling the second conduction terminal of the transistor to a ground node through a second impedance, and turning on the transistor; and placing the electronic device into a power down mode by:

turning off the transistor, applying the DC bias at the second conduction terminal of the transistor, and turning off the low dropout regulator;

wherein turning on the low dropout regulator comprises:

opening a fourth switch that selectively couples an output of an amplifier of the low dropout regulator to the supply node, opening a third switch that selectively couples the output of the low dropout regulator to the supply node, and opening a sixth switch that selectively couples a resistive divider to the ground node.

2. The method of claim 1, wherein turning on the transistor when placing the electronic device into the power on mode comprises turning on the transistor before the DC bias is removed from the second conduction terminal of the transistor.

3. The method of claim 1, wherein turning on the transistor when placing the electronic device into the power on mode comprises turning on the transistor after the DC bias is removed from the second conduction terminal of the transistor.

4. The method of claim 1, wherein turning on the transistor when placing the electronic device into the power on mode comprises turning on the transistor along with removing the DC bias from the second conduction terminal of the transistor.

5. The method of claim 1, wherein turning off the transistor when placing the electronic device into the power down mode comprises turning off the transistor before the DC bias is applied at the second conduction terminal of the transistor.

6. The method of claim 1, wherein turning off the transistor when placing the electronic device into the power down mode comprises turning off the transistor after the DC bias is applied at the second conduction terminal of the transistor.

7. The method of claim 1, wherein turning off the transistor when placing the electronic device into the power down mode comprises turning off the transistor along with applying the DC bias at the second conduction terminal of the transistor.

8. The method of claim 1, wherein turning on the low dropout regulator is performed prior to removing the DC bias from the second conduction terminal of the transistor.

9. The method of claim 1, wherein turning on the transistor is performed by coupling a control terminal of the transistor to the ground node.

10. The method of claim 1, wherein turning off the transistor is performed by coupling a control terminal of the transistor to the supply node.

11. The method of claim 1, wherein applying the DC bias at the second conduction terminal of the transistor is performed by closing the first switch and closing the second switch.

12. The method of claim 1, wherein the first impedance is provided by at least one diode circuit and wherein the second impedance is provided by at least one diode circuit.

13. A method of operating an electronic device comprised of a low dropout regulator having an output coupled to a first conduction terminal of a transistor, with a second conduction terminal of the transistor being coupled to an output node of the electronic device, wherein the method comprises:

placing the electronic device into a power on mode by:
- turning on the low dropout regulator,
- removing a DC bias from the second conduction terminal of the transistor by selectively decoupling the second conduction terminal of the transistor from a supply node and a ground node, and
- turning on the transistor; and placing the electronic device into a power down mode by:
- turning off the transistor,
- applying the DC bias at the second conduction terminal of the transistor by selectively coupling the second conduction terminal of the transistor to the supply node and the ground node, and
- turning off the low dropout regulator;

wherein turning on the transistor when placing the electronic device into the power on mode comprises turning on the transistor after the DC bias is removed from the second conduction terminal of the transistor;

wherein the low dropout regulator is turned on by:
- opening a first switch to decouple an output of an amplifier of the low dropout regulator from the supply node,
- opening a second switch to decouple the output of the low dropout regulator from the supply node, and
- opening a third switch to couple a resistive divider to the ground node.

14. The method of claim 13, wherein turning on the transistor is performed by selectively coupling a control terminal of the transistor to the ground node.

15. The method of claim 13, wherein turning off the transistor is performed by selectively coupling a control terminal of the transistor to the supply node.

16. The method of claim 13, wherein the DC bias is generated via a first impedance coupled between the second conduction terminal of the transistor and the supply node and a second impedance coupled between the second conduction terminal and the ground node.

17. A method of operating an electronic device comprised of a low dropout regulator having an output coupled to a first conduction terminal of a transistor, with a second conduction terminal of the transistor being coupled to an output node of the electronic device, wherein the method comprises:

placing the electronic device into a power on mode by:
- turning on the low dropout regulator,
- removing a DC bias from the second conduction terminal of the transistor by selectively decoupling the second conduction terminal of the transistor from a supply node and a ground node, and
- turning on the transistor; and placing the electronic device into a power down mode by:
- turning off the transistor,
- applying the DC bias at the second conduction terminal of the transistor by selectively coupling the second conduction terminal of the transistor to the supply node and the ground node, and
- turning off the low dropout regulator;

wherein turning off the transistor when placing the electronic device into the power down mode comprises turning off the transistor after the DC bias is applied at the second conduction terminal of the transistor;

wherein the low dropout regulator is turned on by:
- opening a first switch to decouple an output of an amplifier of the low dropout regulator from the supply node,
- opening a second switch to decouple the output of the low dropout regulator from the supply node, and
- opening a third switch to couple a resistive divider to the ground node.

18. The method of claim 17, wherein turning on the transistor is performed by selectively coupling a control terminal of the transistor to the ground node.

19. The method of claim 17, wherein turning off the transistor is performed by selectively coupling a control terminal of the transistor to the supply node.

20. The method of claim 17, wherein the DC bias is generated via a first impedance coupled between the second conduction terminal of the transistor and the supply node and a second impedance coupled between the second conduction terminal and the ground node.

* * * * *